US011847898B2

(12) United States Patent
Escofet Via et al.

(10) Patent No.: US 11,847,898 B2
(45) Date of Patent: Dec. 19, 2023

(54) ADAPTIVE FIRE DETECTION

(71) Applicant: Carrier Corporation, Palm Beach Gardens, FL (US)

(72) Inventors: Jordi Escofet Via, Gava (ES); Andrés Córdoba Galera, Barcelona (ES); Ramon De La Torre, Barcelona (ES); Jairo Muñoz Rodríguez, Barcelona (ES)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/890,336

(22) Filed: Aug. 18, 2022

(65) Prior Publication Data

US 2023/0038916 A1 Feb. 9, 2023

Related U.S. Application Data

(62) Division of application No. 17/078,585, filed on Oct. 23, 2020, now Pat. No. 11,455,875.

(30) Foreign Application Priority Data

Oct. 25, 2019 (EP) ..... 19382931

(51) Int. Cl.
*G08B 17/10* (2006.01)
*G08B 17/06* (2006.01)
(Continued)

(52) U.S. Cl.
CPC ..... *G08B 17/10* (2013.01); *G08B 17/06* (2013.01); *G08B 21/182* (2013.01); *G08B 21/22* (2013.01); *G08B 29/043* (2013.01)

(58) Field of Classification Search
CPC ..... G08B 17/10; G08B 17/06; G08B 21/182; G08B 12/22; G08B 29/043
See application file for complete search history.

(56) References Cited

U.S. PATENT DOCUMENTS 5,931,233 A * 8/1999 La Bonte ..... A62C 37/40 169/48
8,143,567 B2 3/2012 Williams et al.
(Continued)

FOREIGN PATENT DOCUMENTS

DE 102015114832 A1 4/2016
EP 1124210 A1 8/2001
EP 3147879 A1 3/2017

OTHER PUBLICATIONS

European Search Report for Application No. 19382931.4, dated Apr. 3, 2020, 8 Pages.

*Primary Examiner* — Ojiako K Nwugo
(74) *Attorney, Agent, or Firm* — CANTOR COLBURN LLP

(57) ABSTRACT

A fire detection system (10) includes a plurality of smoke detectors (14) positioned for detection of smoke within one or more smoke detection volumes (12*a*, 12*b*). The fire detection system (10) is configured to monitor occupancy of the smoke detection volumes (12*a*, 12*b*) or to receive data indicative of occupancy of the smoke detection volumes (12*a*, 12*b*), for example from an intrusion detection system (20). The fire detection system (10) is configured to adjust a smoke sensitivity associated with each of the smoke detectors (14) based on the occupancy of the respective smoke detection volume (12*a*, 12*b*), with the smoke sensitivity being decreased when the respective smoke detection volume (12*a*, 12*b*) is occupied.

8 Claims, 1 Drawing Sheet

(51) Int. Cl.

| | |
|---|---|
| ***G08B 21/18*** | (2006.01) |
| ***G08B 21/22*** | (2006.01) |
| ***G08B 29/04*** | (2006.01) |

(56) References Cited

U.S. PATENT DOCUMENTS

| | | | | |
|---|---|---|---|---|
| 8,502,660 | B2 | 8/2013 | Hick | |
| 9,396,633 | B1 | 7/2016 | Sannala | |
| 10,458,844 | B2 | 10/2019 | Ramer et al. | |
| 10,529,223 | B2 | 1/2020 | Kalagani et al. | |
| 2007/0080819 | A1 | 4/2007 | Marks et al. | |
| 2010/0052576 | A1 | 3/2010 | Steiner et al. | |
| 2010/0052894 | A1 | 3/2010 | Steiner et al. | |
| 2010/0102962 | A1 | 4/2010 | Hick | |
| 2010/0207759 | A1 | 8/2010 | Sloan et al. | |
| 2012/0011126 | A1* | 1/2012 | Park | G06F 9/546 707/769 |
| 2012/0169507 | A1 | 7/2012 | Dyer et al. | |
| 2013/0201017 | A1 | 8/2013 | Oppelt et al. | |
| 2014/0035753 | A1 | 2/2014 | Cooke et al. | |
| 2014/0058567 | A1 | 2/2014 | Matsuoka et al. | |
| 2014/0058806 | A1 | 2/2014 | Guenette et al. | |
| 2014/0167969 | A1 | 6/2014 | Wedig et al. | |
| 2015/0306436 | A1* | 10/2015 | Chattaway | A62C 13/76 169/26 |
| 2016/0104358 | A1* | 4/2016 | Meier | G08B 29/22 340/628 |
| 2016/0232549 | A1* | 8/2016 | Guenette | G06Q 30/0207 |
| 2018/0011455 | A1 | 1/2018 | Camarasa et al. | |
| 2018/0058930 | A1 | 3/2018 | Ramer et al. | |
| 2018/0128478 | A1 | 5/2018 | Beyer | |
| 2018/0136053 | A1 | 5/2018 | Birnkrant et al. | |
| 2018/0227141 | A1 | 8/2018 | Zribi et al. | |
| 2018/0314219 | A1 | 11/2018 | Gamroth et al. | |
| 2018/0350220 | A1 | 12/2018 | Gonzales | |
| 2019/0028270 | A1 | 1/2019 | Foisy et al. | |
| 2020/0044876 | A1 | 2/2020 | Piccolo, III et al. | |
| 2020/0066125 | A1 | 2/2020 | Boguslawski et al. | |
| 2020/0200422 | A1* | 6/2020 | Xu | G05B 15/02 |
| 2020/0402381 | A1 | 12/2020 | Nelson et al. | |
| 2021/0051199 | A1* | 2/2021 | McKee | H04L 41/5009 |
| 2021/0158679 | A1 | 5/2021 | Escofet Via et al. | |

* cited by examiner

ADAPTIVE FIRE DETECTION

FOREIGN PRIORITY

This application is a divisional of U.S. patent application Ser. No. 17/078,585, filed Oct. 23, 2020, the entire contents of which are incorporated herein by reference, claims priority to European Patent Application No. 19382931.4, filed Oct. 25, 2019, and all the benefits accruing therefrom under 35 U.S.C. § 119, the contents of which in its entirety are herein incorporated by reference.

TECHNICAL FIELD

The present invention relates to fire detection, and particularly to fire detection in a building using multiple smoke sensitivity levels.

BACKGROUND

Various methods exist for detection of fire, but a common technique is by detection of smoke within the building. A smoke detector has the purpose of reacting to smoke and relaying this information either through a built-in alarm or through an alarm of a fire control panel connected to the smoke detector. For some types of fire detection systems, it is possible to adjust the sensitivity of the alarm's responsiveness to smoke.

In some existing systems, the smoke sensitivity is adjusted controlled using a timer. For example, the smoke sensitivity may be set to a low level during the day when usage of a space is typically higher, and to a higher level overnight when usage is low. The reason for this is that people in the vicinity of the smoke detector cause pollution which can trigger false alarms.

At least the preferred embodiments of the present disclosure seek to further improve upon such fire detection systems.

SUMMARY

Viewed from a first aspect, the present invention provides a method comprising adjusting a smoke sensitivity of a fire detection system based on occupancy of a smoke detection volume associated with the fire detection system.

The fire detection system may comprise a smoke detector, which may be provided within the smoke detection volume. The smoke detector may detect a concentration of suspended particulates within the smoke detection volume The smoke sensitivity is a sensitivity of the fire detection system to smoke within the smoke detection volume.

The method may comprise triggering an action by the fire detection system responsive to determining that a level of particulates within the smoke detection volume is above a threshold level. Adjusting the smoke sensitivity may comprise adjusting this threshold.

The action may comprise triggering an audible and/or visual alarm. Such alarms serve to alert occupants of the need to evacuate. The action may comprise sending an alert to an external recipient, such as to a system operator and/or to a fire service provider or another appropriate emergency service provider. The action may comprise triggering a fire protection system or a fire suppression system, optionally those associated with a specific smoke detection volume and/or an adjacent smoke detection volume. Exemplary fire protection systems may comprise fire door or fire barrier release systems or other systems designed to inhibit progress of a fire. Exemplary fire suppression systems may include wet or dry sprinkler systems, or gaseous fire suppression systems.

The action may be triggered by the smoke detector, i.e. the determination may be performed by integral processing logic within the smoke detector. Alternatively, the alarm may be triggered by a fire control panel associated with a plurality of discrete smoke detectors.

Wherein the sensitivity of the fire detection system is increased when the smoke detection volume has low or no occupancy, and wherein the sensitivity of the smoke detector is reduced when the smoke detection volume is occupied or has high occupancy.

Occupancy of the smoke detection volume may be detected using a sensor positioned to monitor the smoke detection volume. In this context, occupancy is human occupancy, i.e. the presence and/or the number of people within the smoke detection volume The sensor may comprise an ambient light sensor. The sensor may comprise a motion sensor. The sensor may comprise an infrared light sensor, and preferably a passive infrared light sensor. The sensor may comprise a camera. Further exemplary sensors may include a motion sensor, a sound sensor such as an infrasound sensor or an ultrasonic sensor, a microwave sensor, a radar sensor, a photoelectric beam, and a carbon monoxide sensor.

The sensor may be a sensor associated with an intrusion detection system or with a lighting control system or with an access control system. Alternatively, the sensor may comprise part of the fire detection system. Optionally, the sensor may be integral with a smoke detector provided within the smoke detection volume.

The smoke detection volume is preferably located within a building, and more preferably within a commercial or industrial building.

Viewed from a second aspect, the present invention provides a fire detection system comprising a smoke detector for detecting smoke within a smoke detection volume, wherein the fire detection system is configured to receive occupancy data indicative of occupancy of the smoke detection volume or monitor occupancy of the smoke detection volume, and to adjust a smoke sensitivity associated with the smoke detector based on the occupancy of the smoke detection volume.

The smoke detector may be configured to detect a concentration of suspended particulates within the smoke detection volume.

The fire detection system may be configured to trigger an action responsive to determining that a level of particulates within the smoke detection volume is above a threshold level. Adjusting the sensitivity may comprise adjusting this threshold.

The action may comprise triggering an audible and/or visual alarm. Such alarms serve to alert occupants of the need to evacuate. The action may comprise sending an alert to an external recipient, such as to a system operator and/or to a fire service provider or another appropriate emergency service provider. The action may comprise triggering a fire protection system or a fire suppression system, optionally those associated with a specific smoke detection volume and/or an adjacent smoke detection volume. Exemplary fire protection systems may comprise fire door or fire barrier release systems or other systems designed to inhibit progress of a fire. Exemplary fire suppression systems may include wet or dry sprinkler systems, or gaseous fire suppression systems.

The fire detection system may comprise a plurality of smoke detectors. The plurality of smoke detectors may each be associated with a common fire control panel. The fire control panel may be configured to trigger the action.

The smoke detector may integral processing logic. The integral processing logic of the smoke detector may be configured to trigger the action responsive to determining that a level of particulates within the smoke detection volume is above a threshold level. The action may comprise triggering an alarm, which may be integral with the smoke detector.

The fire detection system may be configured to increase the smoke sensitivity when the smoke detection volume has low or no occupancy, and the fire detection system may be configured to decrease the smoke sensitivity when the smoke detection volume is occupied or has high occupancy.

The fire detection system may comprise an occupancy sensor, which may be configured to monitor occupancy of the smoke detection volume. The occupancy sensor may be integral with the smoke detector, or may be separate from the smoke detector.

The sensor may comprise an ambient light sensor. The sensor may comprise a motion sensor. The sensor may comprise an infrared light sensor, and preferably a passive infrared light sensor. The sensor may comprise a camera. Further exemplary sensors may include a motion sensor, a sound sensor such as an infrasound sensor or an ultrasonic sensor, a microwave sensor, a radar sensor, a photoelectric beam, and a carbon monoxide sensor.

The fire detection system may be configured to receive occupancy data from an intrusion detection system or from a lighting control system or from an access control system.

Viewed from a third aspect, the present invention provides a building comprising the smoke detection volume and a fire detection system as set out above. The fire detection system may comprise any one or more or all of the optional features described above.

Optionally, the building may comprise an intrusion detection system or a lighting control system or an access control system that is in communication with the fire control system and/or is configured to supply occupancy data to the fire control system.

The intrusion detection system or the lighting control system or the access control system may comprise an occupancy sensor, which may be configured to monitor occupancy of the smoke detection volume.

The sensor may comprise an ambient light sensor. The sensor may comprise a motion sensor. The sensor may comprise an infrared light sensor, and preferably a passive infrared light sensor. The sensor may comprise a camera. Further exemplary sensors may include a motion sensor, a sound sensor such as an infrasound sensor or an ultrasonic sensor, a microwave sensor, a radar sensor, a photoelectric beam, and a carbon monoxide sensor.

The building is preferably a commercial or industrial building.

Viewed from a fourth aspect, the present invention provides a computer program product or a tangible computer-readable medium storing a computer program product, wherein the computer program product comprises computer-readable instructions that when executed will cause a fire control system to perform any method according to the first aspect.

Optionally, the computer-readable instructions may cause the fire detection system to perform any one or more or all of the optional steps described above.

BRIEF DESCRIPTION OF THE DRAWINGS

Preferred embodiments of the present disclosure will now be described in greater detail, by way of example only and with reference to the accompanying drawings, in which.

DETAILED DESCRIPTION

A building having a fire detection system 10 typically comprises one or more smoke detection volumes 12. These may include substantially isolated volumes of space within the building, such as rooms within the building, as well as non-delineated volume of space such as part of a room within the building. Two rooms are illustrated as first and second smoke detection volumes 12*a*, 12*b* in FIG. 1.

Figure 1:
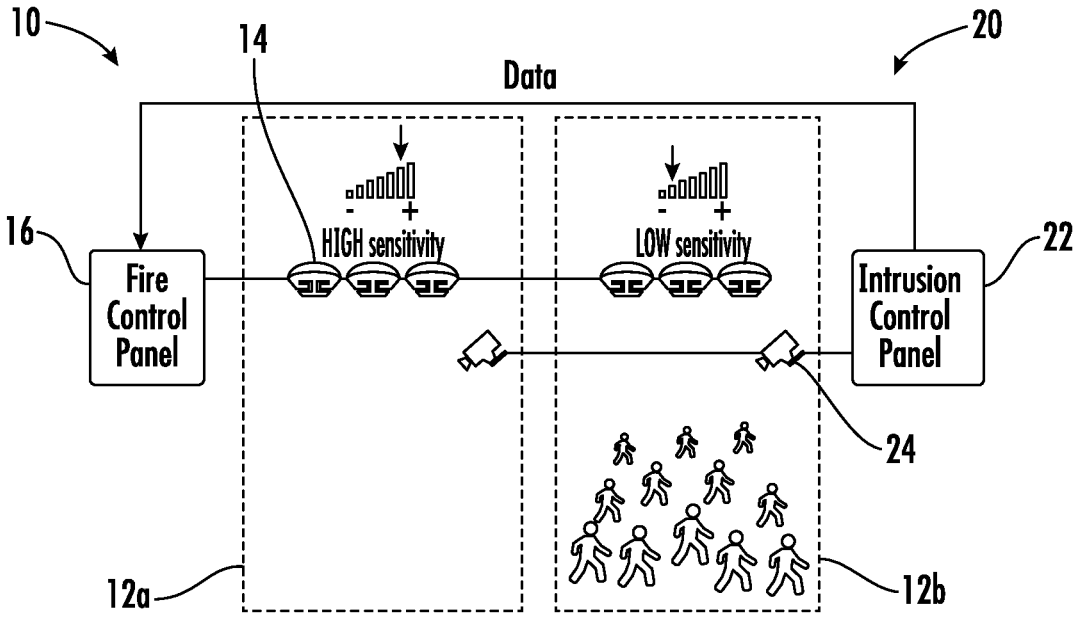
FIG. 1 shows a fire detection system monitoring two smoke detection volumes using different smoke sensitivities.

Within each smoke detection volume 12 is provided at least one smoke detector 14—in the example shown in FIG. 1, three smoke detectors 14 are present in each of the smoke detection volumes 12. A smoke detector 14 is a device capable of detecting the presence of smoke within its local vicinity. Many types of smoke detector 14 exist, but are broadly classified as either ionisation smoke detectors or photoelectric smoke detectors. Photoelectric smoke detectors are more commonly used, but both types of smoke detector 14 are compatible with the present disclosure. The manner of operation of such smoke detectors 14 is well known to those in the technical field, and will not be described in detail.

Each of the smoke detectors 14 associated with the fire detection system 10 is in communication with a fire control panel 16 of the fire detection system 14. Typically, this communication is via a wired network installed within the building. However, wireless communication may be used in some instances. The smoke detectors 14 each periodically transmit a level of particulates detected within the respective smoke detection volume 12 to the fire control panel 16.

The fire control panel 16 monitors the detected level of particulates and determines whether or not it is necessary to take one or more action. The action may comprise triggering an audible and/or visual alarm within the building. Such alarms serve to alert occupants of the building of the need to evacuate. The action may comprise sending an alert to a recipient external to the building, such as to a building operator and/or to a fire service provider or another appropriate emergency service provider. The action may comprise triggering a fire protection system or a fire suppression system within the building, optionally those associated with a specific smoke detection volume and/or nearby smoke detection volumes. Exemplary fire protection systems may comprise fire door or fire barrier release systems or other systems designed to inhibit progress of a fire. Exemplary fire suppression systems may include wet or dry sprinkler systems, or gaseous fire suppression systems.

Whether an action needs to be taken is determined based on whether one or more action criteria are met. That is to say, responsive to determining that an action criterion is met, the fire control panel 16 will perform one or more action associated with that action criterion.

The action criteria will usually include at least the determination that any smoke detector 14 indicates that a level of particulates within its smoke detection volume exceeds a respective threshold. Different thresholds may be used for different smoke detectors 14, and the threshold used for each smoke detector 14 may be based on the smoke detection volume 12 being monitored by that smoke detector 14.

In accordance with the following embodiments, the threshold is a variable threshold, which is varied based on an estimated occupancy of the smoke detection volume 12 being monitored by that smoke detector 14. Occupancy is intended to refer herein to the presence (and optionally the number) of people within the smoke detection volume 12.

In the most basic example, two thresholds may be used. A low threshold is used when the smoke detection volume 12 is believed to be unoccupied (e.g. the first smoke detection volume 12*a*), which corresponds to a high sensitivity to smoke. A high threshold is used when the smoke detection volume 12 is believed to be occupied by at least one person (e.g. the second smoke detection volume 12*b*), corresponding to a low sensitivity to smoke.

The presence of people within a smoke detection volume 12 can cause increased levels of pollution within the smoke detection volume 12. Such pollution primarily includes increased levels of dust and particulate matter that is disturbed into the air due to movement of those people. However, people can also introduce specific particulate pollution into the air within the smoke detection volume 12. For example, by the use of aerosols, the use of kettles or other steam sources, etc.

Thus, whilst the smoke detection volume 12 is occupied, it is desirable to reduce the "smoke" sensitivity of the fire detection system 10 to avoid false alarms. This does mean that a real fire might proceed undetected by the smoke detectors 14 of the fire detection system for longer than it would at the higher smoke sensitivity setting. However, when the smoke detection volume 12 is occupied, it is expected that the occupants of the smoke detection volume 12 would manually trigger the fire detection system 10 in the event of a fire.

In the converse situation, when the smoke detection volume 12 is unoccupied, the smoke sensitivity can be increased so as to detect a real fire as soon as possible. This is particularly important when the smoke detection volume 12 is unoccupied because there would be no occupants to manually trigger the fire detection system 10 in the event of a fire.

In a more advanced example, more than two thresholds may be used. For example, a low threshold may be used when the smoke detection volume 12 is believed to be unoccupied. A medium threshold is used when the smoke detection volume 12 is believed to be occupied by a small number of people. A high threshold is used when the smoke detection volume 12 is believed to be occupied by a large number of people.

The use of multiple thresholds advantageously allows more precise control of the smoke sensitivity of the fire detection system 10. This is useful because the level of pollution will typically increase based on the number of occupants of the smoke detection volume 12. In this example, three thresholds are used, but it will be appreciated that any number of thresholds may be used. In a further example, the threshold may be determined as a function of the estimated degree of occupancy of the smoke detection volume 12.

The action criteria may additionally include a determination that two or more smoke detectors 14 within the same smoke detection volume 12 indicate that a level of particulates within that smoke detection volume 12 exceeds a respective, second threshold. This second threshold may be set to a lower level than the first threshold discussed above. As above, however, the second threshold may again be a variable threshold, which is varied based on an estimated occupancy of the smoke detection volume 12 being monitored by those smoke detectors 14.

Whilst occupancy of a smoke detection volume 12 is expected to be the primary factor affecting the threshold(s) used, other factors may also be taken into account. For example, the threshold(s) may be adjusted based on occupancy of an adjacent smoke detection volume 12, on the basis that the occupants and/or pollution may move between smoke detection volumes 12.

Additionally, a time delay may be introduced before changing the smoke sensitivity of the fire detection system 10, particularly before increasing the smoke sensitivity following a reduction in occupancy of the smoke detection volume 12. This provides time for any pollution to subside before increasing the smoke sensitivity of the fire detection system 10.

FIG. 1 illustrates an embodiment of the above technique. In this embodiment, a fire control panel 16 receives smoke detection data from a plurality of smoke detectors 14 positioned in two smoke detection volumes 12*a*, 12*b*. The fire control panel 16 is further in communication with an intrusion control panel 22 of an intrusion detection system 20 of the building.

The intrusion detection system 20 comprises sensors 24 within each of the smoke detection volumes 12 which are capable of detecting occupancy of the smoke detection volumes 12. In this example, the sensors 24 are illustrated as video cameras 24. However, intrusion detection systems often use many other types of sensor to detect occupancy of a space. Exemplary sensors suitable for detection of occupancy may include motion sensors, ambient light sensors, infrared sensors, sound detectors such as infrasound sensors and ultrasonic sensors, microwave detectors, radar, photoelectric beams, and carbon monoxide sensors.

The intrusion control panel 22 may transmit unprocessed sensor data to the fire control panel 16, or may transmit processed data to the fire control panel 16. The processed data may include, for example, an indication of whether each smoke detection volume 12 is occupied or unoccupied, and optionally an estimate of the number of occupants within each smoke detection volume 12.

In response to the data received from the intrusion control panel 22, the fire control panel 16 may adjust the smoke sensitivity for each of the smoke detection volumes 12 as discussed above.

In the illustrated embodiment, the fire detection system 10 and the intrusion detection system 20 are illustrated as having separate control panels 16, 22. However, in some implementations, these systems 10, 20 may be combined as an integrated security system providing both fire detection and intrusion detection functions, which may optionally have a single, integrated security control panel.

In further embodiments, the fire control panel 16 may utilise sensors that do not form part of the intrusion control system 20. That is to say, the fire detection system 10 may be provided with sensors (not shown) within some or all of the smoke detection volumes 12 which are capable of detecting occupancy of the respective smoke detection volumes 12. Such sensors may include any of the exemplary sensors discussed above.

In a further embodiment, the fire control panel 16 may receive data from a lighting control system of the building (not shown). Typically, when a space within a building is occupied, the occupant will turn the lights on, and when the occupant leaves they will turn the lights off. Thus, the lighting control system may provide an indication of occupancy of a smoke detection volume 12.

Furthermore, some lighting control systems may include occupancy sensors for controlling the lighting within the building. The data from such occupancy sensors may be provided to the fire control panel 16.

Alternatively, where interaction between the lighting control system and the fire detection system is not possible, a similar effect can be achieved by providing ambient light sensors within the smoke detection volumes 12. The ambient light sensors measure whether lights within the smoke detection volume are switched on or not, which provides an indication of whether the smoke detection volume is occupied.

In yet a further embodiment, the fire control system may receive data from an access control system of the building (not shown). The access control system may monitor entry and/or exit of personnel into and out of one or more a smoke detection volume(s) 12, so as to thereby provide an estimation of the number of people within the smoke detection volume(s) 12.

The access control system may comprise one or more access control barriers, such as doors, gates, turnstiles. The access control barriers may be capable of monitoring access therethrough, or may be accompanied by access validation units, such as a keypad for entering a password or a device capable of reading biometric data or an access control token. Exemplary access control tokens may include badges, cards, keys, key fobs, and the like. The building access control system may also include one or more of the sensors discussed above, such as cameras, PIR sensors, etc.

The access control system may comprise an access control panel receiving data from the access control barriers and/or access validation units. The building access control panel may transmit the data to the fire control panel, or the control panels may be integrated with one another.

Figure 2:
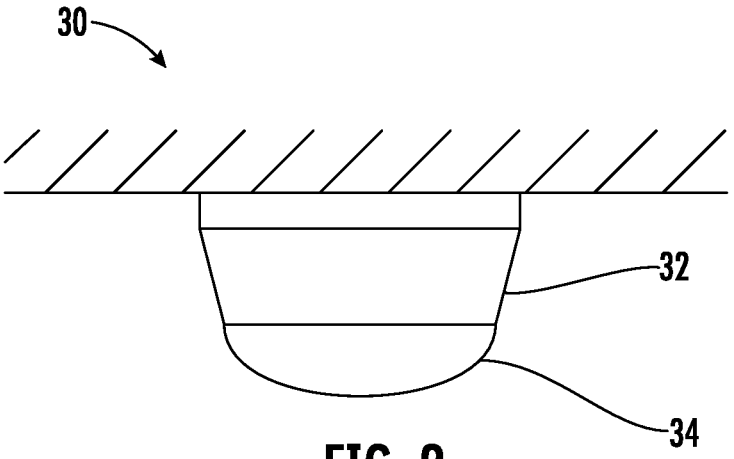
FIG. 2 shows a smoke detector comprising an integral occupancy detection sensor.

FIG. 2 illustrates an embodiment of a smoke detector 30 that may be used in combination with the fire control panel discussed above.

The smoke detector 30 comprises a smoke sensor 32 and an occupancy sensor 34. The smoke sensor 32 is capable of detecting a level of particulates within the vicinity of the smoke detector 30, and may be either an ionisation smoke sensor or photoelectric smoke sensor. The occupancy sensor 34 is capable of detecting the presence of people within the vicinity of the smoke detector 30.

In the illustrated example, the occupancy sensor 34 comprises a passive infrared (PIR) sensor and an ambient light sensor. The use of two different occupancy sensors 34 provided on the smoke detector 30 can improve the accuracy of the detection of people within the vicinity of the smoke detector 30. It will be appreciated that, in alternative embodiments only a single sensor may be used in the occupancy sensor 34, or that the occupancy sensor 34 may comprise any one or more of the sensors discussed above.

The smoke detector 30 may be provided within a smoke detection volume 12 of the fire detection system 10. In one embodiment, the smoke detector 30 periodically transmits a level of particulates detected within a respective smoke detection volume to the fire control panel 16, as well as an estimated occupancy of the smoke detection volume 12. The fire control panel 16 can then make an assessment as to whether action is required.

In an alternative embodiment, the smoke detector 30 may be capable of independently assessing whether action is required. For example, the smoke detector 30 may be capable of determining that the level of particulates within its smoke detection volume 12 exceeds a respective threshold, where the threshold is determined as discussed above based on occupancy determined by the occupancy sensor.

The action taken by the smoke detector 30 may comprise transmitting an alert to the fire control panel 16. The fire control panel 16 may then determine whether further action is required.

The action taken by the smoke detector 30 may comprise triggering an audible and/or visual alarm, which may be integrally provided within the smoke detector 30. That is to say, the smoke detector 30 may be a self-contained unit that is capable of operation independent of the fire control panel 16, i.e. afire detection system 10 may comprise only a single smoke detector 30 without a fire control panel 16.

The above described fire detection systems 10 are particularly applicable to commercial or industrial buildings, especially where parts of the building will spend large amounts of time unoccupied. However, it will be appreciated that the techniques described herein are not limited to such applications and may be employed in fire detection systems used for other types of building, such as residential buildings, or indeed to fire detection systems employed in other environments such as in vehicles or shipping containers.

What is claimed is:

1. A method comprising adjusting a smoke sensitivity of a fire detection system based on occupancy of a smoke detection volume associated with the fire detection system, wherein the smoke detection volume is located within a building and occupancy of the smoke detection volume is detected using data received from an access control system of the building;

wherein the fire detection system is configured to trigger an action responsive to determining that a level of particulates within the smoke detection volume is above a threshold level;

wherein the fire detection system comprises a fire control panel, and wherein the fire control panel is configured to trigger the action.

2. A method according to claim 1, further comprising triggering an action by the fire detection system responsive to determining that a level of particulates within the smoke detection volume is above a threshold level.

3. A method according to claim 2, wherein the threshold is decreased when the smoke detection volume has low or no occupancy, and wherein the threshold is increased when the smoke detection volume is occupied or has high occupancy.

4. A method according to claim 1, wherein the building is a commercial or industrial building.

5. A computer program product comprising an non-transitory computer-readable medium storing computer-readable instructions that when executed will cause a fire detection system to perform the method according to claim 1.

6. A fire detection system comprising a smoke detector for detecting smoke within a smoke detection volume, wherein the fire detection system is configured to receive occupancy data indicative of occupancy of the smoke detection volume or monitor occupancy of the smoke detection volume, and to adjust a smoke sensitivity associated with the smoke detector based on the occupancy of the smoke detection volume, wherein the smoke detection volume is located within a building and occupancy of the smoke detection volume is detected using data received from an access control system of the building;

wherein the fire detection system is configured to trigger an action responsive to determining that a level of particulates within the smoke detection volume is above a threshold level;

wherein the fire detection system comprises a fire control panel, and wherein the fire control panel is configured to trigger the action.

7. A fire detection system according to claim 6, wherein the smoke detector comprises an integral alarm and integral processing logic, and wherein the integral processing logic of the smoke detector is configured to trigger the alarm responsive to determining that a level of particulates within the smoke detection volume is above a threshold level.

8. A fire detection system according to claim 6, wherein the threshold is decreased when the smoke detection volume has low or no occupancy, and wherein the threshold is increased when the smoke detection volume is occupied or has high occupancy.

* * * * *